US012402701B2

(12) United States Patent
Serman

(10) Patent No.: US 12,402,701 B2
(45) Date of Patent: Sep. 2, 2025

(54) PUSH-PULL TYPE ANTI-DROPPING CARD PACKAGE

(71) Applicant: Leonid vitalievich Serman, North Highlands, CA (US)

(72) Inventor: Leonid vitalievich Serman, North Highlands, CA (US)

( * ) Notice: Subject to any disclaimer, the term of this patent is extended or adjusted under 35 U.S.C. 154(b) by 0 days.

(21) Appl. No.: 18/945,411

(22) Filed: Nov. 12, 2024

(65) Prior Publication Data

US 2025/0064186 A1 Feb. 27, 2025

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS 5,466,166 A * 11/1995 Law ..... H05K 5/0295 439/157
7,267,147 B2 * 9/2007 Tiscione ..... A45C 11/182 150/147
10,306,963 B2 * 6/2019 Van Geer ..... B65D 83/08
11,839,277 B1 * 12/2023 Peng ..... A45C 11/182
12,029,294 B1 * 7/2024 Zeng ..... A45C 11/182
12,053,067 B1 * 8/2024 Hu ..... A45C 1/06
2010/0038000 A1 * 2/2010 Ho ..... A45C 11/182 150/147
2015/0282580 A1 * 10/2015 Chen ..... A45C 11/182 206/425
2018/0140061 A1 * 5/2018 Chan ..... G07D 9/004
2018/0310681 A1 * 11/2018 Wingerter ..... B42F 17/32
2018/0338593 A1 * 11/2018 Scharnigg ..... A45C 11/182
2021/0219685 A1 * 7/2021 Van Geer ..... B65D 83/08
2021/0282518 A1 * 9/2021 Schepper ..... A45C 11/182
2022/0061485 A1 * 3/2022 Rodriguez ..... G09F 3/207
2024/0049848 A1 * 2/2024 Du ..... A45C 11/182
(Continued)

FOREIGN PATENT DOCUMENTS

CN 112535342 A * 3/2021
CN 213428799 U 6/2021
CN 216568771 U 5/2022
(Continued)

OTHER PUBLICATIONS

DE 102023127496 A: English Translation (Year: 2025).*

*Primary Examiner* — Nathan J Jenness
*Assistant Examiner* — Justin Caudill

(57) ABSTRACT

A push-pull type anti-dropping card package includes a storage shell, a bottom of the storage shell is provided with a base, a card pushing rod is movably arranged on the base, a pushing rod is arranged on a side wall of the storage shell and abuts against one end of the card pushing rod, a pushing block is movably arranged on an upper part of the side wall of the storage shell and connected with a top of the pushing rod, a fastening block is movably arranged on the top of the pushing rod, a lower part of the fastening block abuts against an inner side surface of the pushing rod, an elastic pressing block is arranged on a vertical surface of the inner side wall of the storage shell opposite to the fastening block, and a movable fastening block is arranged in the card package.

8 Claims, 5 Drawing Sheets

(56) References Cited

U.S. PATENT DOCUMENTS

2024/0327099 A1* 10/2024 Yu ..... B65D 85/62

FOREIGN PATENT DOCUMENTS

| | | | | | |
|---|---|---|---|---|---|
| CN | 219742056 | U | | 9/2023 | |
| DE | 202023106123 | U1 | * | 12/2023 | ..... A45C 11/182 |
| WO | WO-2024114526 | A1 | * | 6/2024 | |
| WO | WO-2024140361 | A1 | * | 7/2024 | |

* cited by examiner

PUSH-PULL TYPE ANTI-DROPPING CARD PACKAGE

CROSS-REFERENCE TO RELATED APPLICATIONS

This application claims foreign priority of Chinese Patent Application No. 202422459183.5, filed on Nov. 11, 2024 in the China National Intellectual Property Administration, the disclosures of all of which are hereby incorporated by reference.

TECHNICAL FIELD

The present invention relates to a push-pull type anti-dropping card package, and relates to the technical field of card package equipment.

BACKGROUND OF THE PRESENT INVENTION

In people's daily life, cards such as business cards or bank cards are often used, and card packages are needed for storage, thus facilitating storage and use of the cards.

In order to facilitate the storage of the cards, a pressing type, a sliding type and other structures are employed in the existing card packages. For example, the patent technology with the publication number of CN220916773U discloses a card package, which comprises a shell, wherein the shell is provided with a first accommodating cavity and a first accommodating opening, the first accommodating cavity is surrounded by a side wall of the shell, the first accommodating opening is communicated with the first accommodating cavity, and the first accommodating cavity is used for accommodating a card; and a pushing device, wherein the pushing device is connected with the shell, and is used for pushing the card out of the first accommodating cavity through the first accommodating opening. Through the above structure, a user can easily push the card in the first accommodating cavity out of the first accommodating cavity in a direction of towards the first accommodating opening by the pushing device, which is convenient for the user to get the desired card accurately and quickly. However, in this structure, a fastening structure for card storage is only realized by an elastic piece on one side. Although a certain fastening effect is achieved, the card can still be thrown out of the card package when carrying since only one side provides pressure, which affects use experience.

SUMMARY OF THE PRESENT INVENTION

The present invention aims at providing a push-pull anti-dropping card package aiming at the defects or deficiencies in the prior art. A movable fastening block is arranged in the card package, which can push a fastening block to clamp a card in the card package when pushing a pushing block, and matches with an anti-slip block in the card package to effectively limit the card, thus effectively preventing the card from falling out of the card package and greatly improving user experience.

In order to achieve the above objects, the following technical solutions are employed in the present invention. The push-pull anti-dropping card package comprises a storage shell 1, wherein a bottom of the storage shell is provided with a bas 2, a card pushing rod 3 is movably arranged on the base 2, a pushing rod 4 is arranged on a side wall of the storage shell 1 and abuts against one end of the card pushing rod 3, a pushing block 5 is movably arranged on an upper part of the side wall of the storage shell 1 and connected with a top of the pushing rod 4, a fastening block 7 is movably arranged on the top of the pushing rod 4, a lower part of the fastening block 7 abuts against an inner side surface of the pushing rod 4, and an elastic pressing block 9 is arranged on a vertical surface of the inner side wall of the storage shell 1 opposite to the fastening block 7.

Further, an inner side of the top of the pushing rod is provided with an ejector block 4-1, and a pushing block fixing groove 4-2 is arranged below the ejector block 4-1.

Further, a bottom of the pushing rod 4 is provided with a matching groove 4-3.

Further, a fixing block 6 is arranged at an inner top of the storage shell 1, a lower section of the fixing block 6 sinks to form a fastening block movable groove 6-1, and a fastening block fixing column 6-2 is arranged on the fastening block movable groove 6-1.

Further, an upper part of the fastening block 7 is provided with a fixing groove 7-1, the fixing groove 7-1 is matched with the fastening block fixing column 6-2, one side of a lower part of the fastening block 7 opposite to the ejector block 4-1 is recessed inward to form a card groove 7-2, a shape of the card groove 7-2 is matched with a shape of the ejector block 4-1, a bottom of the fastening block 7 is an abutting part 7-3, and a protruding abutting block 7-4 is arranged above the abutting part 7-3.

Further, a pressing block mounting plate 8 is arranged at a top of an inner side of the storage shell 1, and a mounting groove is formed on the pressing block mounting plate 8 to match with the elastic pressing block 9.

Further, both sides of an inner wall of the storage shell 1 are provided with a fastening strip 10.

Further, the side wall of the storage shell 1 is provided with a pushing block sliding groove 1-1, a hand-held part 1-2 with anti-slip stripes is arranged below the pushing block sliding groove 1-1, and the top of the storage shell 1 is provided with a card outlet groove 1-3.

Further, a spring 11 is arranged in a middle of the card pushing rod 3 and connected with one end of the base 2, and a front end of the card pushing rod 3 is of a stepped structure.

The working principle of the present invention is as follows: when the card is loaded into the storage shell 1, both sides of an upper part of the card are constrained by the elastic pressing block 9 and the abutting block 7-4, and both sides of a card body are fastened by the fastening strips 10. For example, when it is not necessary to take the card for use, the pushing block 5 is pushed upward to drive the pushing rod 4 to move upward, so that the ejector block 4-1 is clamped into the card groove 7-2, the whole fastening block 7 rotates inward, and the abutting block 7-4 and the abutting part 7-3 simultaneously press the card for fastening. Under the action of the ejector block 4-1, it can be ensured that the card will not fall off easily due to an external force in the storage shell 1. When the card needs to be taken out, the pushing block 5 is pushed downward to drive the pushing rod 4 to descend, and the ejector block 4-1 will fall out of the card groove 7-2, thus releasing the constraint of the fastening block 7 on the card. When the matching groove 4-3 presses a protruding part at a tail end of the card pushing rod 3 during a descending process of the pushing rod 4, the card pushing rod 3 is forced to rotate, and a stepped part at the front end pushes the cards one by one. The spring 11 drives the card pushing rod 3 to reset, after taking the required card, the card is pressed back into the storage shell 1, and then the pushing block 5 is pushed upward to re-lock the card, thus effectively preventing the card from coming out.

After employing the foregoing technical solutions, the present invention has the following beneficial effects. One movable fastening block is arranged in the card package, which can push the fastening block to clamp the card in the card package when pushing the pushing block, and matches with the anti-slip block in the card package to effectively limit the card, thus effectively preventing the card from falling out of the card package and greatly improving the user experience.

DESCRIPTION OF THE DRAWINGS

In order to illustrate the technical solutions in the embodiments of the present invention or in the prior art more clearly, the drawings used in the description of the embodiments or the prior art will be briefly described below. Obviously, the drawings in the following description are merely some embodiments of the present invention. For those of ordinary skills in the art, other drawings may also be obtained based on these drawings without going through any creative work.

Figure 1:
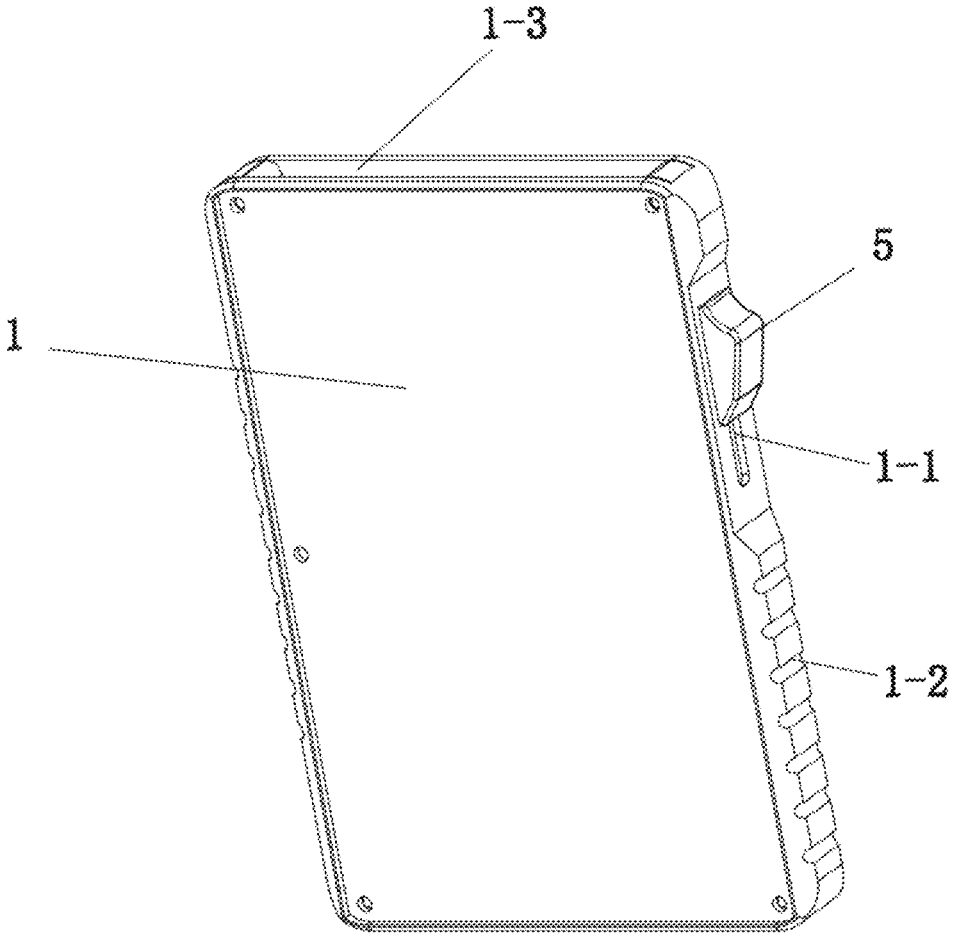
FIG. 1 is a schematic structural diagram of the present invention.

Description of the Reference numerals: storage shell 1; base 2; card pushing rod 3; pushing rod 4; pushing rod 5; fixing block 6; fastening block 7; pressing block mounting plate 8; elastic pressing block 9; fastening strip 10; spring 11; pushing block sliding groove 1-1; hand-held part 1-2; card outlet groove 1-3; ejector block 4-1; pushing block fixing groove 4-2; matching groove 4-3; fastening block movable groove 6-1; fastening block fixing column 6-2; fixing groove 7-1; card groove 7-2; abutting part 7-3; and abutting block 7-4.

DETAILED DESCRIPTION OF PREFERRED EMBODIMENTS

Figure 2:
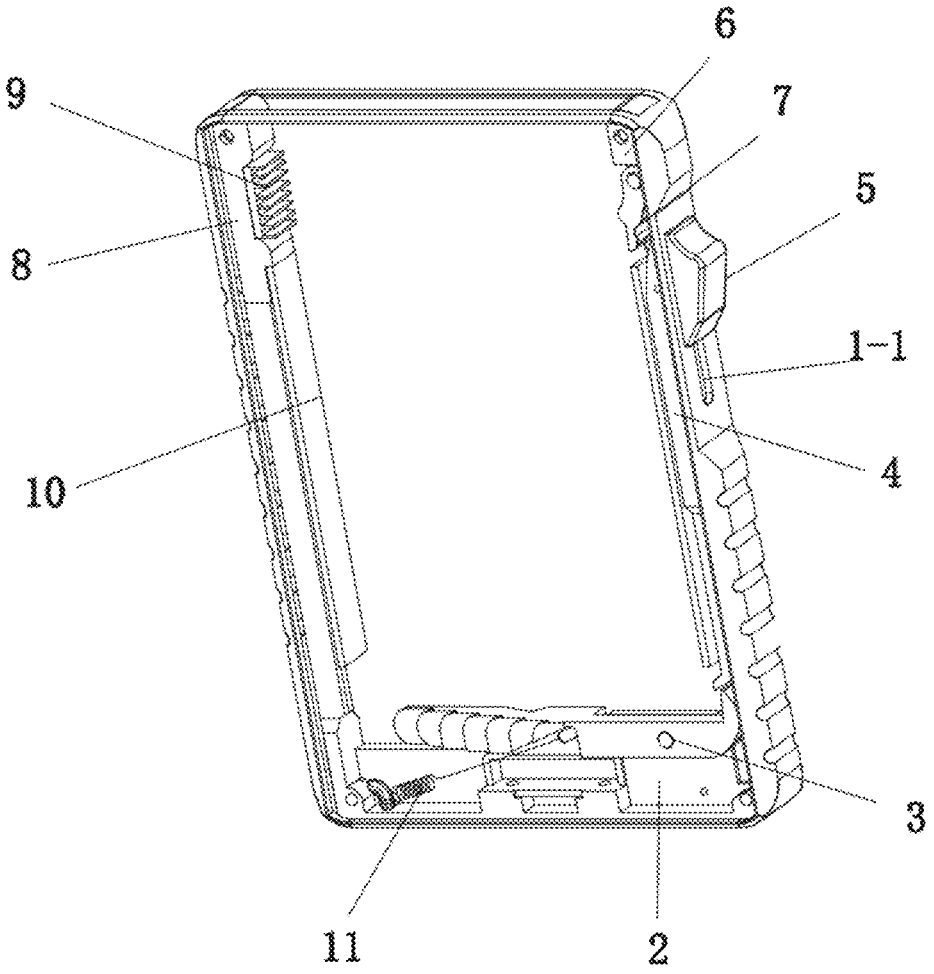
FIG. 2 is a schematic diagram showing an internal structure of the present invention.
Figure 3:
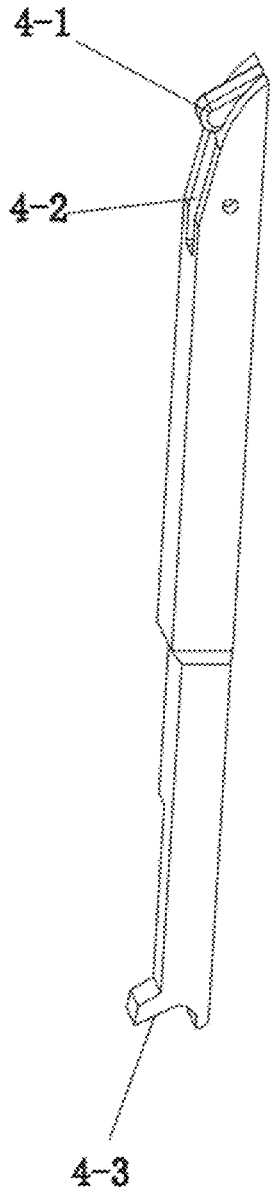
FIG. 3 is a schematic structural diagram of a pushing rod 4 in the present invention.
Figure 4:
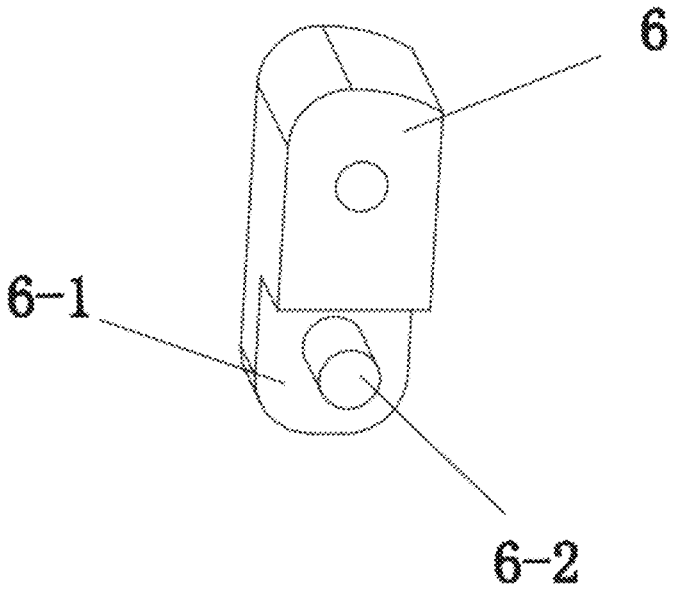
FIG. 4 is a schematic structure diagram of a fixing block 6 in the present invention.
Figure 5:
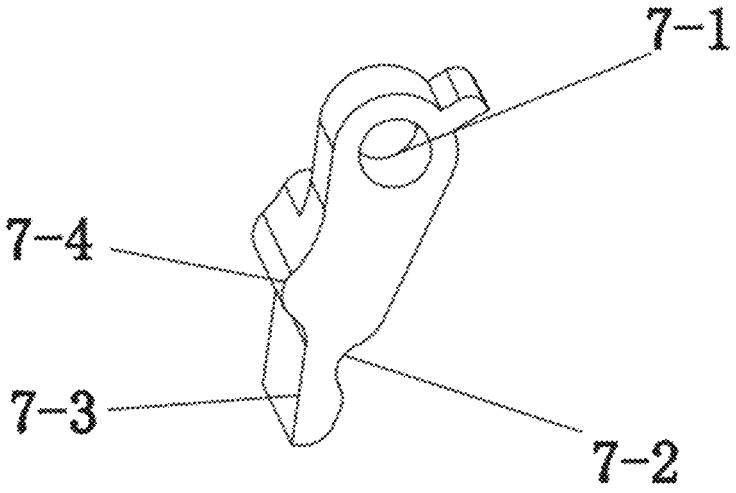
FIG. 5 is a schematic structure diagram of a fastening block 7 in the present invention.
Figure 6:
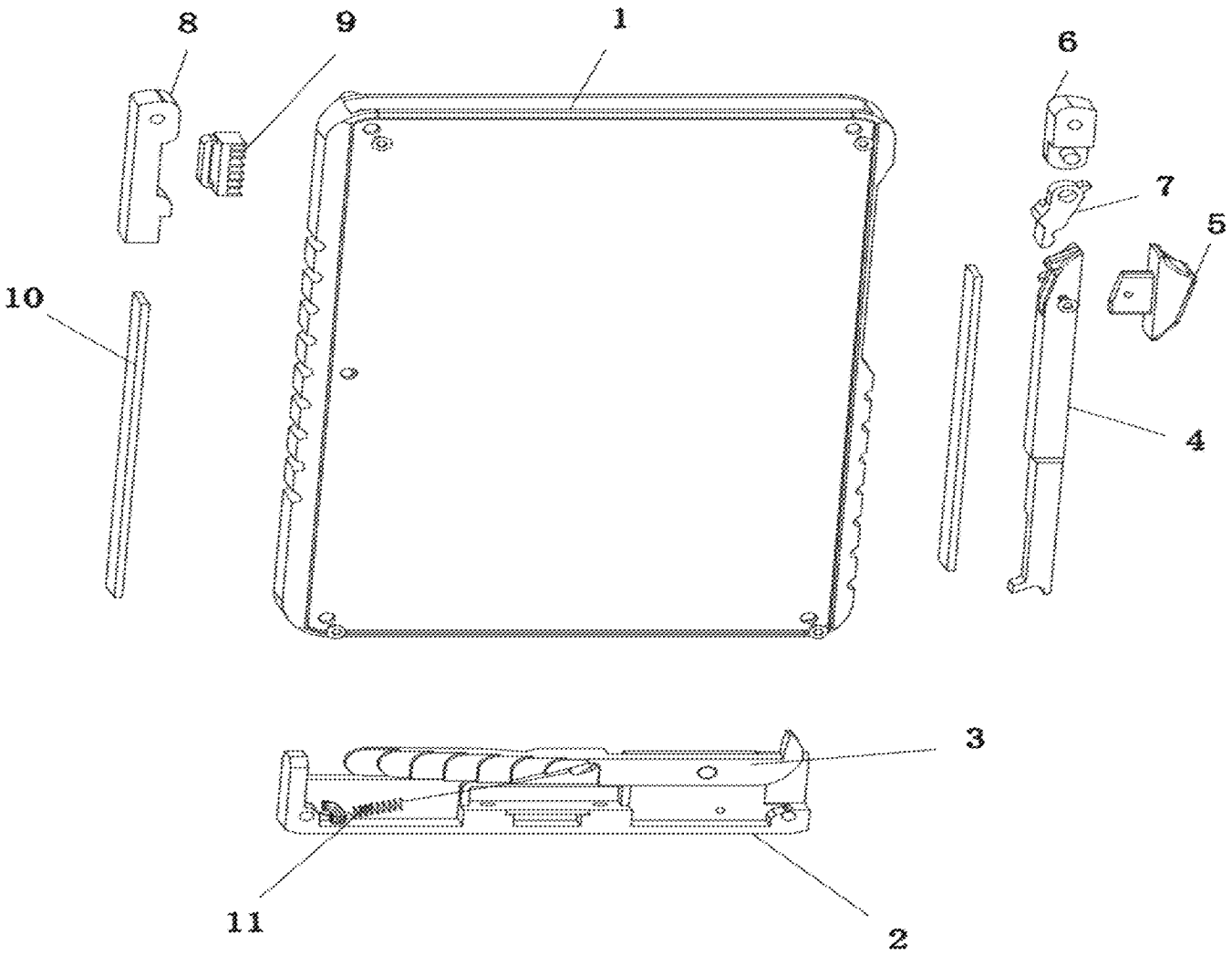
FIG. 6 is a schematic explosion structure diagram of the present invention.

As shown in FIG. 1 to FIG. 6, the technical solutions employed in the embodiments are as follows: a push-pull anti-dropping card package comprises a storage shell 1, wherein a bottom of the storage shell is provided with a bas 2, a card pushing rod 3 is movably arranged on the base 2, a pushing rod 4 is arranged on a side wall of the storage shell 1 and abuts against one end of the card pushing rod 3, a pushing block 5 is movably arranged on an upper part of the side wall of the storage shell 1 and connected with a top of the pushing rod 4, a fastening block 7 is movably arranged on the top of the pushing rod 4, a lower part of the fastening block 7 abuts against an inner side surface of the pushing rod 4, and an elastic pressing block 9 is arranged on a vertical surface of the inner side wall of the storage shell 1 opposite to the fastening block 7. In this embodiment, one movable fastening block is arranged to match with the pushing rod. Specifically, an inner side of the top of the pushing rod 4 is provided with an ejector block 4-1, and a pushing block fixing groove 4-2 is arranged below the ejector block 4-1. A thin plate is arranged on the pushing block to extend into the pushing block fixing groove and is connected and fixed with the pushing rod through a screw. An upper part of the fastening block 7 is provided with a fixing groove 7-1, the fixing groove 7-1 is matched with the fastening block fixing column 6-2, one side of a lower part of the fastening block 7 opposite to the ejector block 4-1 is recessed inward to form a card groove 7-2, a shape of the card groove 7-2 is matched with a shape of the ejector block 4-1, a bottom of the fastening block 7 is an abutting part 7-3, and a protruding abutting block 7-4 is arranged above the abutting part 7-3. When the pushing block is pushed upward, the pushing rod is driven to move upward, and meanwhile, the pushing block presses the abutting part to move inward and is clamped in the card groove, so that the abutting part and the abutting block press sides of the card and clamp the card together with the elastic pressing block from both sides, so that the card will not be released from the storage shell even if it is subjected to an external force when carrying the card package, thereby effectively improving use experience of a user.

When the card needs to be taken out, the pushing block is pushed downward to make the ejector block come out of the card groove, and a reaction force of the card will make the fastening block reset, thus unlocking the card. The pushing rod continues to descend, and one end of the card pushing rod is pressed down. A spring 11 is arranged in a middle of the card pushing rod 3 and connected with one end of the base 2. A front end of the card pushing rod 3 is of a stepped structure, and the stepped part pushes up the cards one by one, which is convenient for the user to distinguish and take the required card. When the pushing block is released, the pushing rod is driven to reset under the action of the spring, and the pushing rod and the pushing block are driven to reset, which is convenient for next use.

More specifically, a bottom of the pushing rod 4 is provided with a matching groove 4-3, and a matching upward projection is arranged at a tail end of the card pushing rod, and the matching groove presses the upward projection at the tail end of the card pushing rod to make the card pushing rod perform lever movement to jack up the card.

More specifically, a fixing block 6 is arranged at an inner top of the storage shell 1, a lower section of the fixing block 6 sinks to form a fastening block movable groove 6-2, and a fastening block fixing column 6-2 is arranged on the fastening block movable groove 6-1. The fixing block is mainly used for fixing the fastening block, and the fastening block can rotate in the fastening block movable groove through the matching of the fixing groove and the fixing column to lock the card.

More specifically, a pressing block mounting plate 8 is arranged at a top of an inner side of the storage shell 1, and a mounting groove is formed on the pressing block mounting plate 8 to match with the elastic pressing block 9. The elastic pressing block is detachably arranged in the mounting groove of the pressing block mounting plate, which is convenient for replacement after the elastic pressing block is damaged.

More specifically, both sides of an inner wall of the storage shell 1 are provided with a fastening strip 10. Two fastening strips are also provided for better clamping and fixing the card. The fastening strips are made of non-slip rubber strips, which can generate a greater friction and prevent the card from falling off.

More specifically, the side wall of the storage shell 1 is provided with a pushing block sliding groove 1-1, a hand-held part 1-2 with anti-slip stripes is arranged below the pushing block sliding groove 1-1, and the top of the storage shell 1 is provided with a card outlet groove 1-3. In a use process, the hand-held part is held by hand to take and store the card, and the anti-slip stripes of the hand-held part can prevent the card package from accidentally falling off, so the use experience is better, and the card is taken or stored through the card outlet groove. As one thin plate is arranged on the pushing block to extend into the storage shell to connect with the pushing rod, a corresponding pushing block sliding groove needs to be arranged on the side wall of the storage shell to match with the thin plate.

The working principle of the present invention is as follows: when the card is loaded into the storage shell 1, both sides of an upper part of the card are constrained by the elastic pressing block 9 and the abutting block 7-4, and both sides of a card body are fastened by the fastening strips 10. For example, when it is not necessary to take the card for use, the pushing block 5 is pushed upward to drive the pushing rod 4 to move upward, so that the ejector block 4-1 is clamped into the card groove 7-2, the whole fastening block 7 rotates inward, and the abutting block 7-4 and the abutting part 7-3 simultaneously press the card for fastening. Under the action of the ejector block 4-1, it can be ensured that the card will not fall off easily due to an external force in the storage shell 1. When the card needs to be taken out, the pushing block 5 is pushed downward to drive the pushing rod 4 to descend, and the ejector block 4-1 will fall out of the card groove 7-2, thus releasing the constraint of the fastening block 7 on the card. When the matching groove 4-3 presses a protruding part at a tail end of the card pushing rod 3 during a descending process of the pushing rod 4, the card pushing rod 3 is forced to rotate, and a stepped part at the front end pushes the cards one by one. The spring 11 drives the card pushing rod 3 to reset, after taking the required card, the card is pressed back into the storage shell 1, and then the pushing block 5 is pushed upward to re-lock the card, thus effectively preventing the card from coming out.

Those described above are only used to illustrate the technical solutions of the present invention, rather than limiting the present invention. Other modifications or equivalent substitutions made by those of ordinary skills in the art to the technical solutions of the present invention should be included in the scope of the claims of the present invention as long as these modifications or equivalent substitutions do not deviate from the spirit and scope of the technical solutions of the present invention.

I claim:

1. A push-pull type anti-dropping card package, comprising a storage shell (1), wherein a bottom of the storage shell is provided with a base (2), a card pushing rod (3) is movably arranged on the base (2), a pushing rod (4) is arranged on a side wall of the storage shell (1) and abuts against one end of the card pushing rod (3), a pushing block (5) is movably arranged on an upper part of the side wall of the storage shell (1) and connected with a top of the pushing rod (4), a fastening block (7) is movably arranged on the top of the pushing rod (4), a lower part of the fastening block (7) abuts against an inner side surface of the pushing rod (4), and an elastic pressing block (9) is arranged on a vertical surface of the inner side wall of the storage shell (1) opposite to the fastening block (7), and wherein a fixing block (6) is arranged at an inner top of the storage shell (1), a lower section of the fixing block (6) sinks to form a fastening block movable groove (6-1), and a fastening block fixing column (6-2) is arranged on the fastening block movable groove (6-1).

2. The push-pull type anti-dropping card package according to claim 1, wherein an inner side of the top of the pushing rod (4) is provided with an ejector block (4-1), a pushing block fixing groove (4-2) is arranged below the ejector block (4-1), and a thin plate is arranged on the pushing block to extend into the pushing block fixing groove and is fixed with the pushing rod through a screw.

3. The push-pull type anti-dropping card package according to claim 2, wherein an upper part of the fastening block (7) is provided with a fixing groove (7-1), the fixing groove (7-1) is matched with the fastening block fixing column (6-2), one side of a lower part of the fastening block (7) opposite to the ejector block (4-1) is recessed inward to form a snap-fit-card groove (7-2), a shape of the snap-fit-card groove (7-2) is matched with a shape of the ejector block (4-1), a bottom of the fastening block (7) is an abutting part (7-3), and a protruding abutting block (7-4) is arranged above the abutting part (7-3).

4. The push-pull type anti-dropping card package according to claim 1, wherein a bottom of the pushing rod (4) is provided with a matching groove (4-3), and a matching protruding part is arranged at a tail end of the card pushing rod.

5. The push-pull type anti-dropping card package according to claim 1, wherein a pressing block mounting plate (8) is arranged at a top of an inner side of the storage shell (1), and a mounting groove is formed on the pressing block mounting plate (8) to match with the elastic pressing block (9).

6. The push-pull type anti-dropping card package according to claim 1, wherein both sides of an inner wall of the storage shell (1) are provided with a fastening strip (10).

7. The push-pull type anti-dropping card package according to claim 1, wherein the side wall of the storage shell (1) is provided with a pushing block sliding groove (1-1), a hand-held part (1-2) with anti-slip stripes is arranged below the pushing block sliding groove (1-1), and a top of the storage shell (1) is provided with a card outlet groove (1-3).

8. The push-pull type anti-dropping card package according to claim 1, wherein a spring (11) is arranged in a middle of the card pushing rod (3) and connected with one end of the base (2), and a front end of the card pushing rod (3) is of a stepped structure.

* * * * *